United States Patent [19]

Suzuki

[11] 3,955,494

[45] May 11, 1976

[54] DEVICE FOR PREVENTING AN IMAGE OF A PRINTING MASTER FROM BEING PRINTED IN AN INCLINED POSITION

[75] Inventor: Minoru Suzuki, Yokohama, Japan

[73] Assignee: Ricoh Co., Ltd., Tokyo, Japan

[22] Filed: Aug. 2, 1974

[21] Appl. No.: 494,327

[30] Foreign Application Priority Data

Aug. 10, 1973 Japan ..... 48-89812

[52] U.S. Cl. ..... 101/232; 101/242; 271/254

[51] Int. Cl.[2] ..... B41F 13/14

[58] Field of Search ..... 101/242, 232; 271/250, 271/251, 253–255

[56] References Cited

UNITED STATES PATENTS

| | | | |
|---|---|---|---|
| 2,069,918 | 2/1937 | Gegenheimer | 271/253 |
| 2,233,895 | 3/1941 | Mestie | 271/253 |
| 2,643,607 | 6/1953 | Levin et al. | 271/253 |
| 3,519,266 | 7/1970 | Blake et al. | 271/251 |
| 3,550,741 | 12/1970 | Sherman | 271/251 |
| 3,709,484 | 1/1973 | Kister | 271/251 |
| 3,734,490 | 5/1973 | Parks | 271/251 |
| 3,763,775 | 10/1973 | Miles | 101/233 |
| 3,822,644 | 7/1974 | Gazzola et al. | 101/242 |
| 3,835,776 | 9/1974 | Weidman | 101/248 |

*Primary Examiner*—Clyde I. Coughenour
*Assistant Examiner*—William Pieprz
*Attorney, Agent, or Firm*—Dunham, Clark, Griffin & Moran, Cooper

[57] ABSTRACT

A device for duplicating apparatus adapted to prevent an image of a printing master from being printed in an inclined position on copies produced from the printing master mounted in the apparatus. The device comprises, in combination, a pair of delivery rollers adapted to hold therebetween one copy sheet after another as the copy sheets are fed from a sheet feed tray and to deliver the same to the printing position, and means for causing each copy sheet to assume an inclined position immediately before being held between the pair of delivery rollers.

5 Claims, 12 Drawing Figures

DEVICE FOR PREVENTING AN IMAGE OF A PRINTING MASTER FROM BEING PRINTED IN AN INCLINED POSITION

BACKGROUND OF THE INVENTION

This invention relates to a device for preventing an image of a printing master from being printed in an inclined position on copies produced from the printing master in a duplicating apparatus.

In an offset duplicating apparatus or mimeograph, ink is applied to a plate or stencil to form thereon an ink image so that the plate or stencil may serve as a printing master, and a large number of copies are produced from the printing master by transferring the ink image to copy sheets. When such printing master is prepared, the image formed thereon may deviate from the regular position and become inclined with respect to the longitudinal center axis of the plate or stencil (inclined image printing master). Even if the image of the master plate is disposed in the regular position, the printing master may become inclined when mounted in a printing position. If this is the case, all the images printed on copy sheets from the printing master will be inclined with respect to the longitudinal center axis of the copy sheets. This is not desirable because such copies are not acceptable, particularly when the images printed on opposite sides of a copy produced from the printing master are inclined or when a number of copies each having inclined images on opposite sides are bound into a book form.

In one device known in the art for preventing the formation of an inclined image on copies produced from a printing master, an inclined image printing master is caused to be inclined to compensate for the inclination of the image when the printing master is mounted on a master cylinder, so that the image on the printing master can be brought into contact with a copy sheet in the regular position.

In this device, adjustments of the position of the printing master on the master cylinder to compensate for the inclination of the image on the printing master should be effected several times, because it is impossible to ensure correct positioning of the printing master in one operation. Thus, with this device, it has been necessary to remove the ink applied printing master from the master cylinder and mount the same thereon again after interrupting the operation of the duplicating apparatus. This is troublesome and time consuming. Additional disadvantages are that the printing master tends to become wrinkled or damaged, and that the hands of the operator get soiled with ink.

SUMMARY OF THE INVENTION

Accordingly, this invention has as its object the provision of a device for preventing an image of a printing master from being printed in an inclined position on copies produced from the printing master in a duplicating apparatus, the device enabling adjustments of the position of the image printed on each copy sheet to be effected from outside without shutting off the duplicating apparatus and without requiring to adjust the position of the printing master.

According to the invention, there is provided a device for preventing an image of a printing master from being printed in an inclined position on copies produced from the printing master, comprising a pair of delivery rollers adapted to hold therebetween one copy sheet after another successively fed from a sheet feed tray and to deliver each copy sheet to a printing position, and means for adjusting the deflection of the copy sheet from its normal course of movement immediately before being held between said pair of delivery rollers in such a manner that, when the copy sheet is delivered to the printing position, the copy sheet can assume a position in which it is inclined as desired with respect to its regular position.

Other and additional objects and features of the invention will become evident from the description set forth hereinafter when considered in conjunction with the accompanying drawings, in which.

DESCRIPTION OF THE PREFERRED EMBODIMENTS

Figure 1:
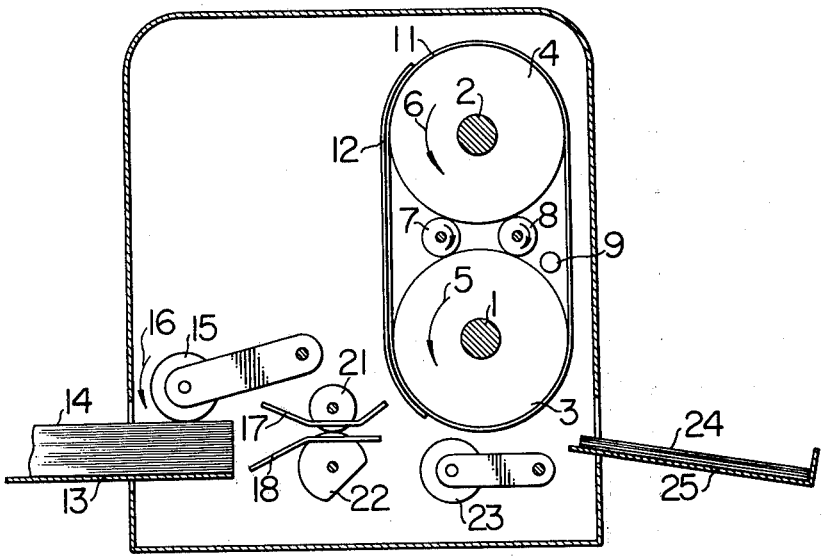
FIG. 1 is a schematic view of a rotary mimeograph.

Embodiments of the invention as incorporated in a mimeograph will now be described with reference to the drawings. In FIG. 1, printing cylinders 3 and 4 mounted on shafts 1 and 2 rotatably supported by an immovable member (not shown) are adapted to rotate in the directions of arrows 5 and 6 respectively. Interposed between the two printing cylinders 3 and 4 and maintained in contact with their outer peripheries are two ink form rollers 7 and 8 which rotate in the directions of arrows for spreading ink on to the printing cylinders 3 and 4 after the ink is supplied through an ink supply tube 9.

A screen 11 is trained about the outer peripheries of printing cylinders 3 and 4 and has a printing master 12 attached thereto in a suitable position. The printing master 12 comprises a stencil consisting of a fiber material and a wax layer provided thereon, and an image is formed on the stencil by removing portions of the wax layer therefrom to expose the fiber material. By bringing the printing master 12 into pressing engagement with the printing cylinder 3 through the screen 11, it is possible to form an ink image on the stencil as the ink oozes through the image. Thus the printing master 12 is ready for production of copies therefrom.

A plurality of copy sheets are piled in a stack on a sheet feed tray 13, with a sheet feed roller 15 being maintained in pressing engagement with the top of the stack of copy sheets 14 by its own weight. As subsequently to be described, the sheet feed roller 15 intermittently rotates in the direction of an arrow 16 to feed one copy sheet after another rightwardly in FIG. 1.

Figure 2:
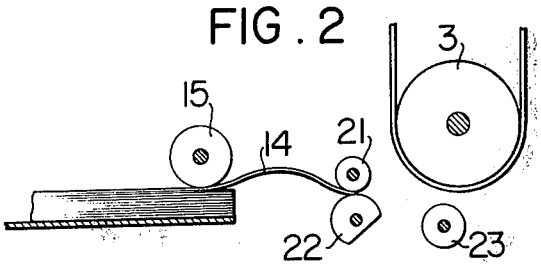
FIG. 2 and FIG. 3 are views in explanation of the manner in which a copy sheet is delivered to the printing position.

Disposed rightwardly of the sheet feed tray 13 are guide plates 17 and 18 and a pair of sheet delivery rollers 21 and 22 which perform the function of delivering a copy sheet 14 from the tray 13 and feeding it to the printing position. As shown in FIG. 2, the movement of copy sheet 14 fed from the sheet feed tray 13 is temporarily interrupted in the position of the pair of delivery rollers 21 and 22. Then, as subsequently to be described in detail, the copy sheet 14 is delivered by the rollers 21 and 22 toward the lower portion of the outer periphery of printing cylinder 3 as the delivery rollers rotate in the directions of the arrows in FIG. 3.

Figure 3:
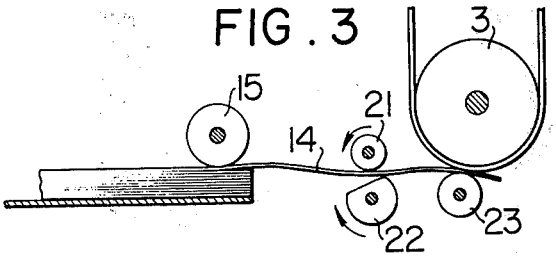

A pressure applying roller 23 is normally disposed in spaced juxtaposed relationship with respect to printing cylinder 3 as shown in FIG. 2. However, as the copy sheet 14 is delivered toward the lower portion of the outer periphery of printing cylinder 3 as shown in FIG. 3, the pressure applying roller 23 moves toward printing cylinder 3 so as to bring the copy sheet 14 into pressing engagement with the printing master 12 and to force the same tightly over the outer periphery of printing cylinder 3, thereby transferring the ink image of the printing master 12 to the copy sheet 14 to produce a copy 24 of the printing master 12. The copy 24 thus produced is discharged from the printing position and ejected on to a copy receiving tray 25.

Figure 7:
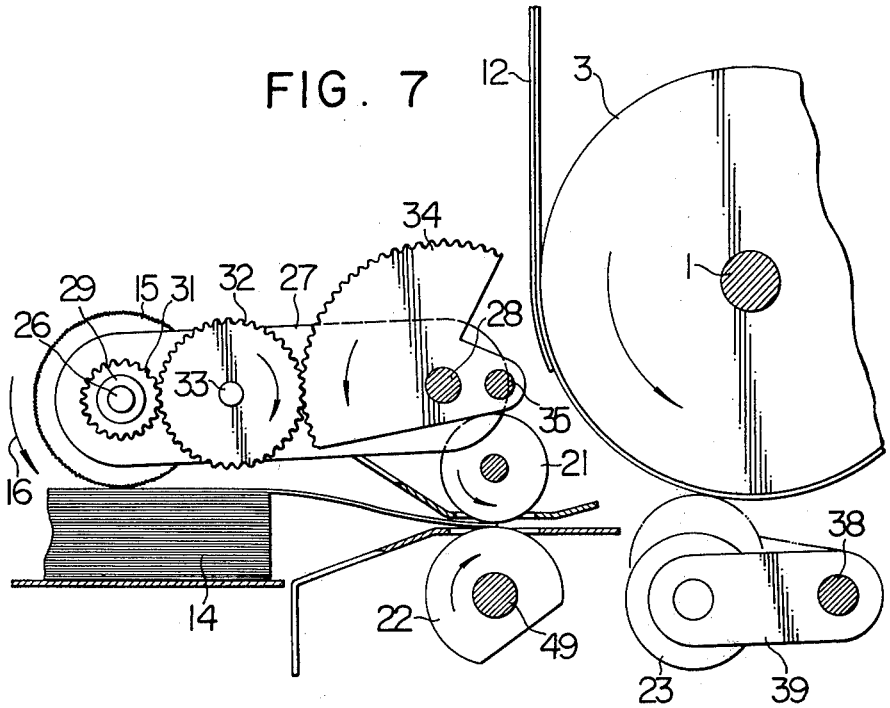
FIG. 7 is a front view of the sheet feed device for the mimeograph.

Referring to FIG. 7, the sheet feed roller 15 is secured to a shaft 26 loosely supported by a free end of a support plate 27 which is pivotally supported at its base by an immovable member (not shown) through a shaft 28. A pinion 31 is mounted, through a one-way rotation clutch 29, on the shaft 26 to which the sheet feed roller 15 is secured, and an idler 32 maintained in meshing engagement with the pinion 31 is supported by the support plate 27 through a shaft 33. Maintained in meshing engagement with the idler 32 is a sector gear 34 which is mounted on shaft 28 for angular rotation and which has a shaft 35 affixed to an arm portion thereof. A connecting bar 37 shown in Fig. 8 is pivotally connected at its base to shaft 35.

Referring to FIG. 7 again, the pressure applying roller 23 disposed beneath printing cylinder 3 is mounted through a shaft at a free end of a support arm 39 which is pivotally supported at its base by a shaft 38 supported by an immovable member (not shown). As aforementioned, the pressure applying roller 23 is moved to a phantom position when the copy sheet 14 is delivered to the printing position, so that the copy sheet 14 can be pressed tightly against the printing master 12 on the outer periphery of printing cylinder 3.

Figure 8:
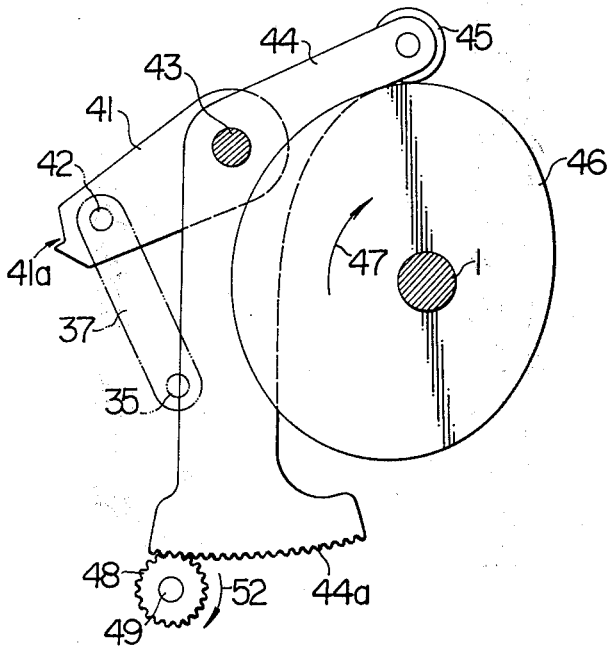
FIG. 8 is a front view of the drive mechanism for the sheet feed device shown in FIG. 7.

Referring to FIG. 8, the connecting bar 37 is pivotally connected at its upper end to a free end of an arm 41 through a shaft 42. The arm 41 is secured at its base to a shaft 43 loosely supported by a side plate (not shown). Shaft 43 has secured to one end thereof a follower 44 which mounts at its free end, through a shaft, a roller 45 which is positioned against the outer periphery of a sheet feed cam 46. The sheet feed cam 46 is mounted on the shaft 1 on which printing cylinder 3 is mounted and adapted to rotate in the direction of an arrow 47.

The follower 44 is formed at its lower end with a drive gear 44a which is maintained in meshing engagement with a pinion 48 mounted on a shaft 49 on which delivery roller 22 (See FIG. 7) is also mounted. The outer periphery of delivery roller 22 is formed therein with a flat portion so as to facilitate the delivery of the sheet 14 to the printing cylinder 3.

The arm 41 is normally locked at its free end 41a by a locking member (not shown) so as to keep the follower 44 in the position shown in FIG. 8. Copy sheet feed is initiated when the arm 41 is released from engagement with the locking member to render the follower 44 free to operate. When rendered free to operate, the follower 44 tracks the sheet feed cam 46 as the latter rotates and moves in pivotal motion about shaft 43.

Upon the follower 44 moving clockwise about shaft 43 in pivotal motion in FIG. 8, the connector 37 moves upwardly and causes the sector gear 34 (See FIG. 7) to rotate angularly in the direction of the arrow. Angular rotation of the sector gear 34 is transmitted, through the idler 32 and pinion 31, to the sheet feed roller 15 which rotates in the direction of the arrow to feed one sheet.

Upon the drive gear 44a of the follower 44 being returned to its original position shown in FIG. 8 by moving counter clockwise after moving clockwise, the pinion 48 is driven to rotate in the direction of an arrow 52. Rotation of the pinion 48 is transmitted to the pair of delivery rollers 21 and 22, so that the two rollers 21 and 22 rotate in the directions of respective arrows. As a result, the uppermost copy sheet 14 on the sheet feed tray 13 is fed to the line of contact between the delivery rollers 21 and 22 when the follower 44 moves clockwise in pivotal motion, and delivered to the printing cylinder 3 when the follower 44 moves counter clockwise in pivotal motion. This sheet feed and delivery operation is repeated each time the sheet feed cam 46 makes one complete revolution, and the sheet 14 delivered by the rollers 21 and 22 to the printing position is brought into pressing contact with the printing master 12 by the pressure applying roller 23, and the copy 24 produced from the printing master 12 is ejected on to the copy receiving tray 25.

Figure 4:
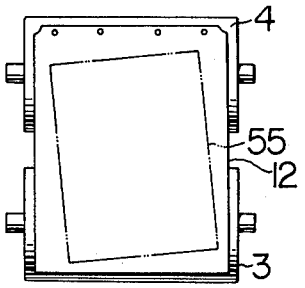
FIG. 4 shows a printing master mounted in the mimeograph and having an image formed thereon in a position in which it is inclined with respect to the longitudinal center axis of the stencil.

In a conventional mimeograph or offset duplicating apparatus of the prior art, it has been common practice to mount the printing master in an inclined position when the image of the printing master is inclined with respect to the longitudinal center axis of the stencil or plate, so that the image may be disposed in the regular position when printed on the sheet. According to the present invention, however, the printing master 12 is mounted on the screen (on the outer periphery of the master cylinder in the case of an offset duplicating apparatus) in a regular manner, regardless of whether or not the image 55 of the printing master 12 (See FIG. 4) is inclined.

Figure 5:
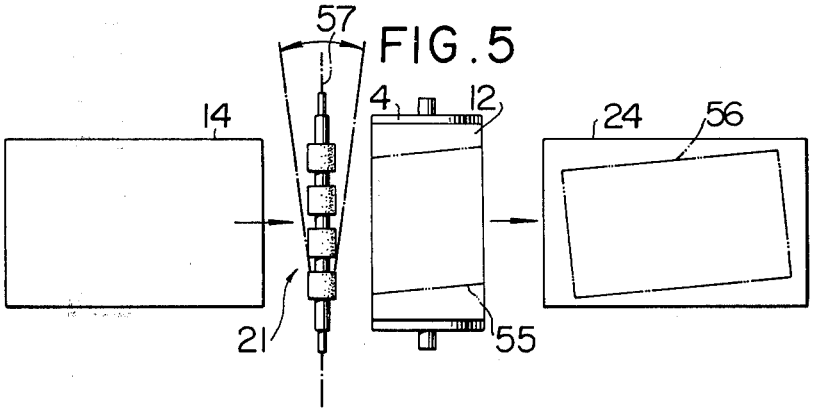
FIG. 5 and FIG. 6 are plan views of the device according to the present invention.

If the image of the printing master mounted on the mimeograph in the regular position is inclined with respect to the longitudinal center axis of the stencil and yet copy sheet feed is effected in the same manner as has hitherto been effected in the prior art, an image 56 printed on the copy 24 produced from the printing master 12 will be inclined with respect to the longitudinal center axis of the sheet as shown in FIG. 5. This is not desirable. In order to obviate this disadvantage, the pair of sheet feed rollers 21 and 22 which are constructed as a unit according to the invention is pivoted at one end and can be moved in either direction from the regular position 57 in which the rollers are disposed at right angles to the direction in which the copy sheets 14 are fed from the sheet feed tray 13, so that deviation of the rollers 21 and 22 from their regular position can be freely adjusted in accordance with the degree of inclination of the image of the printing master 12. The pivotal movement of the rollers 21 and 22 takes place in a plane which is substantially parallel to the direction of movement of the sheet 14.

Figure 6:
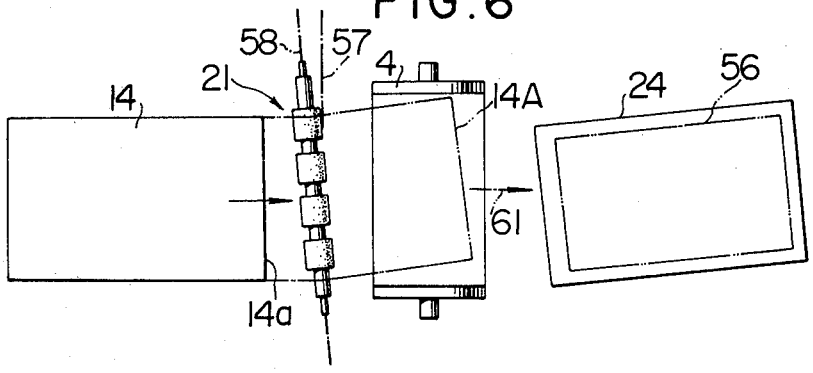

Referring to FIG. 6, if the feed rollers 21 and 22 (roller 22 not being shown) are moved leftwardly in pivotal motion from the regular position 57 to an inclined position 58, a leading edge 14*a* of the sheet 14 moving in the direction of the arrow will temporarily stop in the line of contact between the rollers 21 and 22, and the direction of movement of the sheet 14 with respect to the printing cylinder 3 will be changed as shown in a phantom position 14A when the rollers 21 and 22 begin to rotate. After being brought into pressing engagement with the printing cylinder 3 (See FIG. 7) the sheet 14 is moved in the normal direction as indicated by an arrow 61. Thus, the image 56 printed on the copy 24 produced from the printing master 12 is disposed in the regular position with respect to the longitudinal center axis of the copy sheet as shown in FIG. 6. One form of the mechanism for adjusting the deviation of the pair of feed rollers 21 and 22 from their regular position will now be described.

Figure 9:
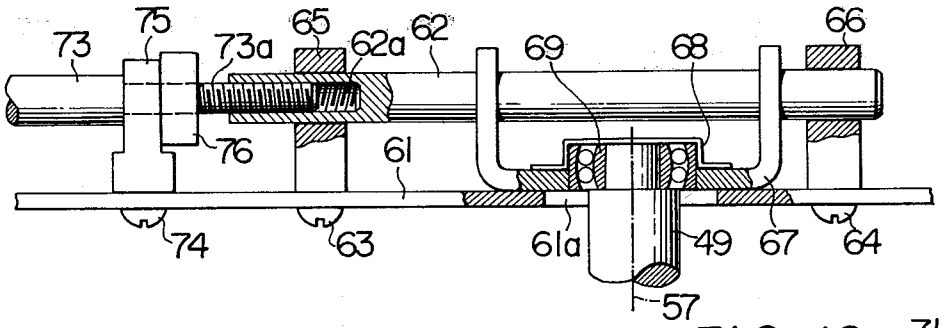
FIG. 9 is a plan view of one embodiment of the device according to the invention.

Referring to FIG. 9, a movable shaft 62 arranged outside a pair of main side plates 61, 61 (only one is shown) is disposed parallel thereto and slidably supported by guides 65 and 66 connected by screws 63 and 64 respectively to one main side plate 61. Secured to the movable shaft 62 is a support member 67 which has affixed thereto through a holder 68 an automatic self-aligning bearing 69 which supports one end portion of the shaft 49 extending through an opening 61a formed in the main side plate 61 (which shaft supports delivery roller 22 as shown in FIG. 10).

Figure 10:
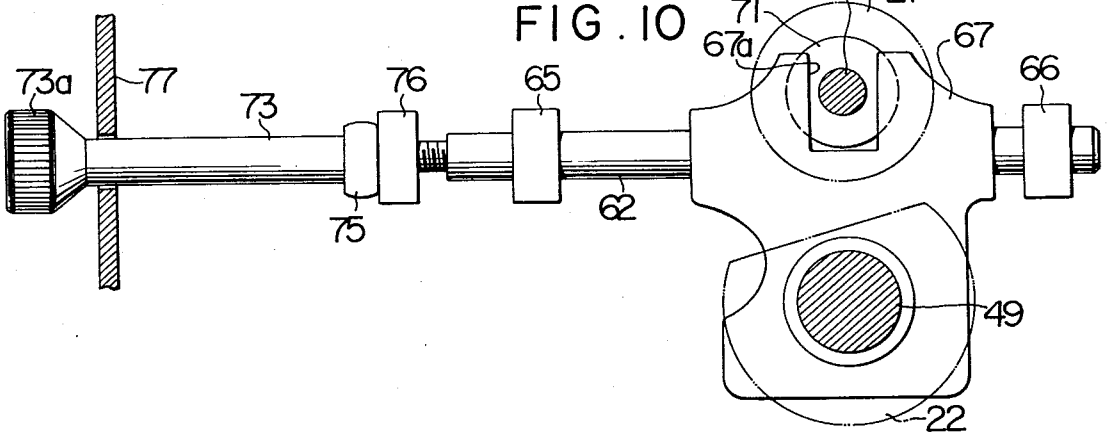
FIG. 10 is a front view of the device shown in FIG. 9.

Referring to FIG. 10, a bearing 71 is mounted in a cutout 67*a* formed in an upper portion of the support member 67. A shaft 72 mounting delivery roller 21 thereon is loosely supported by the bearing 71.

Referring again to FIG. 9, the movable shaft 62 is formed at one end portion thereof with an internally threaded portion 62*a* which threadably receives therein an externally threaded portion 73*a* formed in an end portion of a drive shaft 73 which is loosely supported by a supporter 75 connected to the main side plate 61 by a screw 74. Affixed to the externally threaded portion 73*a* of the drive shaft 73 is a collar 76 which interrupts the sliding movement of the drive shaft 73.

As shown in FIG. 10, the other end portion of drive shaft 73 extends through a side plate 77 and has an operation knob 73*b* attached thereto. By suitably turning the operation handle 73*a* in accordance with the inclination of the image 55 of the printing master 12, it is possible to move rightwardly or leftwardly in FIG. 9 the movable shaft 62 in sliding motion so as to cause the shafts 49 and 72 supporting the feed rollers 22 and 21 to deviate from the normal position 57. Upon the two feed rollers 21 and 22 deviating from the regular position, the direction of movement of the copy sheet 14 fed from the sheet feed tray 13 can be changed whereby the image 56 on the copy 24 can be disposed in the regular position with respect to the sheet.

Figure 11:
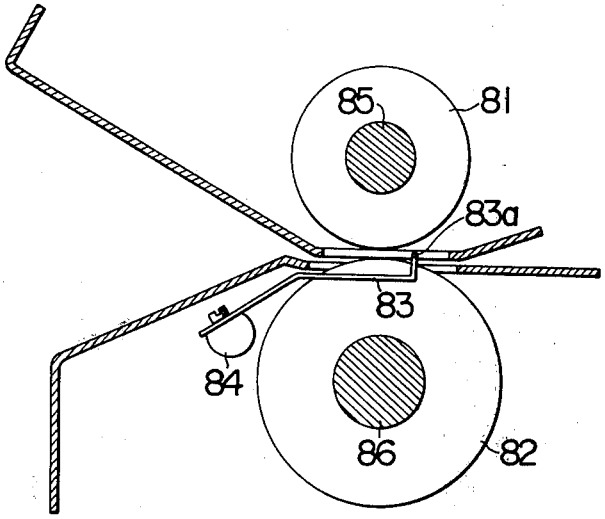
FIG. 11 is a front view of another embodiment of the device according to the invention.
Figure 12:
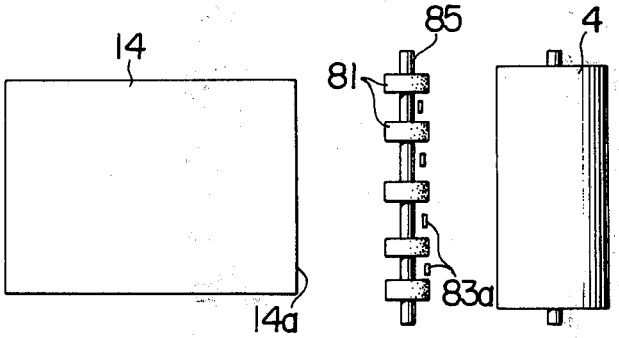
FIG. 12 is a plan view of the device shown in FIG. 11.

FIG. 11 shows another form of the device for controlling the direction of movement of copy sheets fed from the sheet feed tray 13. A pair of delivery rollers 81 and 82 are normally disposed in slightly spaced juxtaposed relationship. However, upon the copy sheet 14 being fed from the sheet feed tray 13 as aforementioned, the upper delivery roller 81 moves downwardly into contact with the lower delivery roller 82. When the two rollers 81 and 82 are brought into contact with each other, the leading end portion of the copy sheet 14 fed from the sheet feed tray 13 is held between the two rollers. A plurality of claws 83*a* are provided at free ends of stop fingers 83 which are mounted at their bases on a shaft 84 loosely supported by an immovable member. As shown in FIG. 12, each of the stop fingers 83*a* is interposed between the adjacent roller units of rollers 81 and 82.

In the form of embodiment shown in FIG. 11, the shafts 85 and 86 supporting the sheet delivery rollers 81 and 82 respectively need not be made to deviate from the regular position as described with reference to the embodiment shown in FIG. 9 and FIG. 10. To attain the end of changing the direction of movement of the copy sheet 14 fed from the sheet feed tray 13, the shaft 84 on which the stop fingers 83 are mounted is manipulated from outside and made to deviate from the regular position. Manipulation of shaft 84 results in the claws 83*a* slightly deviating, as shown in FIG. 12, from their regular positions in which they are parallel to shaft 85. If the copy sheet 14 is fed from the sheet feed tray 13, then the leading end 14*a* of sheet 14 is brought into engagement with the claws 83*a* and the direction of movement of copy sheet 14 is changed by the claws 83*a* which deviate from their regular positions.

Upon completion of feeding of copy sheet 14 as aforementioned, the upper delivery roller 81 is moved downwardly by a mechanism (not shown) to bring the leading end 14*a* of copy sheet 14 into pressing engagement with the lower delivery roller 82. At the same time, the stop fingers 83 are moved clockwise in FIG. 11 and withdrawn from the path of movement of copy sheet 14.

In the embodiment shown in FIG. 11 and FIG. 12, the direction of movement of copy sheet 14 can be changed by causing the stop fingers 83 to deviate from their regular positions in delivering copy sheet 14 to the printing position. By this arrangement, it is possible to obtain the copy 24 on which the image 56 is disposed in the regular position as shown in FIG. 6, in spite of the fact that the image 56 of the printing master 12 deviates from the regular position.

From the foregoing description, it will be appreciated that, according to the present invention, copies in which the image is disposed in the regular position can be produced from a printing master in which the image deviates from the regular position by changing or adjusting the direction of movement of copy sheets in accordance with the deviation of the image of the printing master from its regular position at the pair of delivery rollers after the copy sheets are fed from the sheet feed tray and before they are delivered to the printing position, while mounting such printing master in the regular position in the duplicating apparatus. This adjustment can be effected from outside while trial printing is in progress. Thus, with the device according to the invention, it is not necessary to interrupt the operation of the duplicating apparatus or to handle ink applied printing masters by hand.

What is claimed is:

1. A device for preventing an image of a printing master from being printed in an inclined position with respect to the margins on rectangular copy sheets to which the image is transferred in a duplicating apparatus of the type comprising:

means for cyclicly transporting the printing master through a printing position;

means for feeding copy sheets one by one along a predetermined path of movement to said printing position in a direction substantially perpendicular to the leading edges of said copy sheets; and means cooperating with said transporting means at said printing position for transferring the image on said printing master to said copy sheets;

said device comprising:

means disposed across said predetermined path of movement for receiving said copy sheets from said feeding means and transporting said copy sheets to said printing position;

said receiving means comprising a pair of cooperating feed rollers; and means for selectively varying the orientation of said feed rollers with respect to the leading edges of said copy sheets received thereby to alter the orientation and direction of movement of said copy sheets prior to entering said printing position by such an amount that will compensate for any inclination of the printing master at the printing position.

2. A device as in claim 1 wherein said feed rollers comprise a pair of rollers respectively disposed above and below said predetermined path of movement and engaging each other for transporting said copy sheets therebetween.

3. A device as in claim 2 wherein said orientation varying means comprises means for supporting the ends of said pair of rollers such that the roller axes are at an angle with respect to the leading edges of said copy sheets upon receipt thereof.

4. A device as in claim 2 wherein one roller of said pair of rollers has a flat portion on its outer periphery.

5. A device as in claim 1 further comprising means for rotating said feed rollers and means for interrupting the rotation of said feed rollers.

* * * * *